US005214021A

United States Patent [19]

Takahashi et al.

[11] Patent Number: 5,214,021

[45] Date of Patent: May 25, 1993

[54] PRESSURE SENSITIVE COPY ARTICLE

[75] Inventors: Naoya Takahashi, Yokohama; Satoshi Narui, Ayase; Yasuo Togami, Yokohama; Ryoichi Miura, Ninomiyamachi, all of Japan

[73] Assignee: Nippon Petrochemicals Co., Ltd., Tokyo, Japan

[21] Appl. No.: 477,839

[22] PCT Filed: Aug. 9, 1989

[86] PCT No.: PCT/JP89/00813

§ 371 Date: Apr. 5, 1990

§ 102(e) Date: Apr. 5, 1990

[87] PCT Pub. No.: WO90/01417

PCT Pub. Date: Feb. 22, 1990

[30] Foreign Application Priority Data

| | | | |
|---|---|---|---|
| Aug. 9, 1988 | [JP] | Japan | 63-198453 |
| Aug. 9, 1988 | [JP] | Japan | 63-198454 |
| Aug. 9, 1988 | [JP] | Japan | 63-198455 |
| Aug. 9, 1988 | [JP] | Japan | 63-198456 |

[51] Int. Cl.[5] ..... B41M 5/165

[52] U.S. Cl. ..... 503/213; 503/210; 503/211; 503/212; 503/216; 503/225

[58] Field of Search ..... 427/150–152; 503/213, 215, 225, 210–212, 216

[56] References Cited

U.S. PATENT DOCUMENTS

| | | | |
|---|---|---|---|
| 4,450,123 | 5/1984 | Egawa et al. | 503/215 |
| 4,567,496 | 1/1986 | Ogata et al. | 503/200 |
| 4,749,680 | 6/1988 | Umeda et al. | 503/210 |
| 4,759,797 | 7/1988 | Umeda et al. | 106/30 |
| 4,783,521 | 11/1988 | Yamaguchi et al. | 528/206 |
| 4,835,135 | 5/1989 | Umeda et al. | 503/210 |

*Primary Examiner*—B. Hamilton Hess

*Attorney, Agent, or Firm*—Scully, Scott, Murphy & Presser

[57] ABSTRACT

The present invention is connected with a pressure sensitive copy material using a color former solution in which an electron accepting developer and an electron donating color former capable of developing a color when brought into contact with the developer are dissolved in a solvent, and as the solvent in the color former solution, a solvent composition is used which comprises (a) 5 to 50% by volume of one selected from the group consisting of a hydrogenated lower polymer of propylene and/or a butene, an alicyclic hydrocarbon, an alkylbenzene and a kerosine fraction, and (b) 50 to 95% by volume of a bicyclic aromatic hydrocarbon and/or a chlorinated paraffin oil having a viscosity of 3 cSt or more at 40° C., the aforesaid developer comprising an aromatic carboxylic acid, a polymer thereof, a metallic salt thereof, a polyvalent metallized carboxy-modified terpene phenolic resin or a derivative thereof.

7 Claims, No Drawings

PRESSURE SENSITIVE COPY ARTICLE

TECHNICAL FIELD

The present invention relates to a pressure sensitive copy material which is inexpensive and has high color development velocity. More specifically, it relates to a pressure sensitive copy material which uses a solvent composition comprising one selected from the group consisting of a hydrogenated lower polymer of propylene and/or a butene, an alicyclic hydrocarbon, an alkylbenzene and a kerosine fraction, and a bicyclic aromatic hydrocarbon having at least two non-condensed or condensed aromatic rings and/or a chlorinated paraffin oil; and a developer metallic salt thereof, a polyvalent metallized carboxy-modified terpene phenolic resin or a derivative thereof.

BACKGROUND ART

Heretofore, record materials, i.e., pressure sensitive copy materials have been known which are each composed of a paper coated on one side thereof with microcapsules containing a colorless electron donating agent (hereinafter referred to as "color former") in a solution and another paper coated on the other side thereof with an electron accepting substance (hereinafter referred to as "developer") such as an acidic inorganic material or a carboxylic acid having an ability to develop a color by the reaction with the aforesaid color former. When used, both the papers are superposed on each other so that the respective coated surfaces thereof may face each other, and pressure is then applied onto the superposed papers, so that a copy record is given thereby.

This type of record material has the following copy record mechanism: The microcapsules on the paper are ruptured by the pressure from a pen, a typewriter or the like in order to release a color former solution therefrom, and the latter is then brought into contact with the developer with which the confronted paper has been coated, whereby a color is developed.

Furthermore, another type of record material has also been known in which the respective coating materials of the microcapsules and the developer having such a color developing mechanism are applied onto either surface of one paper.

The color former solution used in the aforesaid record material is a solution in which the electron donating color former is dissolved in one or more hydrophobic solvents. The hydrophobic solvent used herein should satisfy the following requirements:

(1) To be nontoxic, (2) to have no uncomfortable odor, (3) to be colorless or to have a very faint color, (4) to dissolve the coupler sufficiently and to be excellent in stability, (5) to permit forming microcapsules with ease, (6) to ensure the storage stability of the microcapsules, (7) to allow a color developing reaction to occur and to accelerate color development velocity, (8) to permit providing color-developed images without blotting, and to ensure the formation of the clear color-developed images, even after stored for a long period of time, and (9) to be inexpensive.

Examples of the solvent for this kind of record material which have been heretofore used include diarylalkanes such as phenylxylylethane and phenylethylphenylethane, aromatic hydrocarbon oils having plural aromatic rings such as an alkylnaphthalene, an alkylbiphenyl and a partially hydrogenated terphenyl, and chlorinated paraffins.

However, these solvents are expensive, and the pressure sensitive copy materials obtained by using such solvents do not always satisfy the requirement of color development velocity.

The present invention provides a pressure sensitive copy material which can solve the above-mentioned problems of the conventional pressure sensitive copy materials and which is excellent in color development performance and inexpensive.

The pressure sensitive copy material of the present invention can be prepared by combining a specific solvent satisfying the above-mentioned requirements with a specific developer. Particularly, in the inexpensive pressure sensitive copy material of the present invention, an improvement is made in the color development velocity at a low temperature which is one drawback of the conventional pressure sensitive copy materials. It should be noted that in this specification, boiling points mean values in terms of atmospheric pressure, unless otherwise noted.

DISCLOSURE OF THE INVENTION

The present invention is directed to a pressure sensitive copy material using a color former solution in which an electron accepting developer and an electron donating color former capable of developing a color when brought into contact with the developer are dissolved in a solvent, the aforesaid pressure sensitive copy material being characterized in that as the solvent of the solution, a solvent composition is used which comprises (a) 5 to 50% by volume of one selected from the group consisting of a hydrogenated lower polymer of propylene and/or a butene, an alicyclic hydrocarbon, an alkylbenzene and a kerosine fraction having a viscosity of less than 3 cSt at 40° C. and a boiling point of 150° C. or more in terms of atmospheric pressure and (b) 50 to 95% by volume of a bicyclic aromatic hydrocarbon having at least two non-condensed or condensed aromatic rings having a boiling point of 260° C. or more in terms of atmospheric pressure and a viscosity of 3 cSt or more at 40° C. and/or a chlorinated paraffin oil having a viscosity of 3 cSt or more at 40° C. and the developer is one selected from the group consisting of an aromatic carboxylic acid, a polymer thereof, a metallic salt thereof, a polyvalent metallized carboxy-modified terpene phenolic resin and a derivative thereof.

Now, the present invention will be described in detail as follows:

Usable components of the above-mentioned paragraph (a) include a hydrogenated lower polymer of propylene and/or a butene, an alicyclic hydrocarbon, an alkylbenzene, a kerosine fraction and a mixture thereof having a viscosity of less than 3 cSt at 40° C. and boiling point of a 150° C. or more in terms of atmospheric pressure. Anyway, it is important that the component of the paragraph (a) has a viscosity of less than 3 cSt at 40° C. and a boiling point of 150° C. or more in terms of atmospheric pressure.

Examples of the hydrogenated lower polymer of propylene or a butene having a viscosity of less than 3 cSt at 40° C. and a boiling point of 150° C. or more in terms of atmospheric pressure include hydrogenated oligomers obtained by hydrogenating the tetramer and pentamer of propylene as well as trimers and tetramers of butenes such as 1-butene, 2-butene and isobutene. A material prepared by polymerizing and then hydrogenating a $C_4$ fraction from a residual oil of cracked naphtha is also usable. In addition, a material prepared by hydrogenating a mixed olefin lower polymer of propylene and a butene can also be used. The lower polymer can be easily obtained by polymerizing propylene or a butene in the presence of an acid catalyst, for example the Friedel-Crafts catalyst such as aluminum chloride or hydrogen fluoride, and the hydrogenation of the lower polymer can be achieved by an ordinary process using a hydrogenating metallic catalyst such as platinum, palladium or nickel. The hydrogenation decreases the odor of the solvent so as to bring the latter into a preferable state in the present invention.

It is necessary that the viscosity of the hydrogenated lower polymer at 40° C. is less than 3 cSt, and if the viscosity is 3 cSt or more, the improvement in color development characteristics is poor or imperceptible. Furthermore, if the boiling point of the hydrogenated material in terms of atmospheric pressure is less than 150° C., its odor is so strong that the material is not practicable. It is preferred that the main solvent has a boiling point of 170° C. or more.

Examples of the alicyclic hydrocarbon having a viscosity of less than 3 cSt at 40° C. and a boiling point of 150° C. or more in terms of atmospheric pressure in the above paragraph (a) include alkylcyclohexanes, cycloalkylcyclohexanes, alkylcyclopentanes, cycloalkylcyclopentanes, decalin, alkyldecalins and cycloalkyldecalins. They can be prepared by hydrogenating the nuclei of aromatic hydrocarbons such as alkylbenzenes, naphthalene, alkylnaphthalenes, tetralin and alkyltetralins Typically, the alicyclic hydrocarbon may be a fraction mainly comprising alicyclic hydrocarbons which can be prepared by subjecting a suitable petroleum fraction to the nuclear hdyrogenation. It is necessary that the viscosity of the alicyclic hydrocarbon is less than 3 cSt, and if the viscosity is 3 cSt or more, the improvement in color development characteristics is poor or imperceptible. Furthermore, if the boiling point of the alicyclic hydrocarbon in terms of atmospheric pressure is less than 150° C., its odor is so strong that the hydrocarbon is not practicable. It is preferred that the boiling point of the hydrocarbon in terms of atmospheric pressure is 170° C. or more.

Examples of the alkylbenzenes having a viscosity of less than 3 cSt at 40° C. and a boiling point of 150° C. or more in terms of atmospheric pressure in the above paragraph (a) include monoalkylbenzenes and polyalkylbenzenes. In particular, the alkylbenzenes in which the number of the total carbons in the alkyl groups is from 5 to 9 are desirable from the viewpoints of color development performance and odor.

The alkylbenzenes having boiling points of less than 150° C. are not practical from the standpoint of odor. The preferable alkylbenzenes have boiling points of 170° C. or more. It is necessary that the viscosity of the hydrocarbon oil is less than 3 cSt, and a viscosity of 3 cSt or more is not preferable, because the improvement in color development characteristics is poor or imperceptible.

As the kerosine fraction in the above paragaraph (a) obtained by distilling petroleum, a usual kerosine fraction prepared through a petroleum refining process can be employed, but the preferable kerosine is what has been hydrogenated to decrease the odor and to thereby become the practical solvent. Any fraction can be used, so long as it is called the kerosine fraction. Nevertheless, the kerosine fraction mainly comprising a component having a boiling point of 170° C. or more is particularly preferable from the viewpoint of the odor.

With regard to the bicyclic aromatic hydrocarbon having at least two non-condensed or condensed aromatic rings and having a boiling point of 260° C. or more and a viscosity of 3 cSt or more at 40° C. in the above-mentioned paragraph (b), its usable examples include diarylalkanes such as phenylxylylethane, phenylethylphenylethane, phenylcumylethane and phenyl-sec-butylphenylmethane, an alkylnaphthalene such as diisopropylnaphthalene, alkylbiphenyls such as sec-butylbiphenyl and o-, m- and p-isopropylbidiphenyls, partially hydrogenated terphenyl, and mixtures thereof.

As the chlorinated paraffin having a viscosity of 3 cSt or more at 40° C., a chlorinated normal paraffin obtained from a kerosine fraction can be used. In the present invention, any chlorinated paraffin having an optional chlorine content and molecular weight can be used, so long as it satisfies the requirement of the above-mentioned viscosity range.

The bicyclic aromatic hydrocarbon and the chlorinated paraffin may be used singly or in combination. Anyway, it is important that the component of the above-mentioned paragraph (b) has a boiling point of 260° C. or more and a viscosity of 3 cSt or more at 40° C.

When the viscosity of the component in the above paragaraph (b) is less than 3 cSt at 40° C., the improvement in color development characteristics is imperceptible. The upper limit of the viscosity is not particularly restrictive, but when the component is too viscous, a synergistic effect of mixing the components in the above-mentioned paragraphs (a) and (b) is scarcely obtained unpreferably. Therefore, the component having a viscosity of 100 cSt or less at 40° C. is usually employed.

Moreover, the aromatic hydrocarbon having a boiling point of less than 260° C. has a low molecular weight, and therefore its vapor pressure is high, so that its odor is unpreferably strong.

With regard to a mixing ratio between the hydrocarbon having a viscosity of less than 3 cSt at 40° C. which is the component of the above-mentioned paragraph (a) and the aromatic hydrocarbon having at least two non-condensed or condensed aromatic rings or the chlorinated paraffin oil having a boiling point of 260° C. or more in terms of atmospheric pressure and a viscosity of 3 cSt or more at 40° C. which is the component of the above-mentioned paragraph (b), the amount of the former component is from 5 to 50% by volume, and that of the latter component is from 50 to 95% by volume, preferably the amount of the former component is from 5 to 40% by volume, and that of the latter component is from 60 to 95% by volume.

If the amount of the former component is less than 5% by volume, the improvement in color development effect is not confirmed. Inversely, if it is in excess of 50% by volume, the solubility of the coupler is impracticably poor.

In the present invention, it is important to make use, as a developer, an aromatic carboxylic acid, a polymer thereof, a metallic salt thereof, a polyvalent metallized carboxy-modified terpene phenolic resin or a derivative thereof. If a novolak type phenolic resin which is usually used as the conventional developer for pressure sensitive papers is employed, any pressure sensitive copy papers having a high color development velocity cannot be obtained, even if the solvent composition regarding the present invention is employed.

The aromatic carboxylic acid as the developer is an organic compound in which a carboxyl group is directly bonded to an aromatic ring (which may be monocyclic or polycyclic), and examples of such an aromatic carboxylic acid include derivatives of salicylic acid, for example, 3,5-di(α-methylbenzyl)salicylic acid, 3-(α-methylbenzyl)-5-(α,α'-dimethylbenzyl)salicylic acid, 3-(4'-α,α'-dimethylbenzyl)phenyl-5-(α,α'-dimethylbenzyl)salicylic acid, 3,5-di-tert-butylsalicylic acid, 3,5-di-tert-octylsalicylic acid, 3-cyclohexyl-5-(α,α'-dimethylbenzyl)salicylic acid, 3-phenyl-5-(α,α'-dimethylbenzyl)-salicylic acid and 3,5-di(α,α'-dimethylbenzyl)salicylic acid. In addition, an aromatic carboxylic acid to which a styrene compound is added, for example, a styrenated salicylic acid is also usable. The particularly preferable aromatic carboxylic acids are aromatic carboxylic acids each having 15 or more carbon atoms in all. However, when the aromatic carboxylic acid is used as a monomer for copolycondensation or copolymerization, the number of the carbon atoms is not particularly limited.

Furthermore, another example of the developer which can be used in the present invention is an addition polymerization resin, a condensation resin or a copolycondensation resin, for example, salicylic acid resin which can be prepared by using an aromatic carboxylic acid, particularly, salicylic acid as a comonomer. Examples of the copolycondensation resin include a copolycondensation resin of salicylic acid and a dialkoxyxylene as well as a polymerization product of salicylic acid and an aldehyde. Trialkylbenzenes can also be used as the monomers for the copolycondensation.

In addition, metallic salts of these aromatic carboxylic acids and polymers thereof are also usable. Examples of the metallic salts include salts of polyvalent metals such as zinc, aluminum, barium, tin, iron, calcium and lead.

The aromatic carboxylic acids, the polymers thereof and the metallic salts thereof can be prepared by a process described in U.S. Patent Publication No. 4,783,521.

The polyvalent metallized carboxy-modified terpene phenolic resin or the derivative thereof may be prepared by first condensing a cyclic monoterpene and a phenol in the presence of an acid catalyst to form a copolycondensation resin, then introducing a carboxyl group to the copolycondensation resin in a usual manner to produce a carboxyl-modified terpene phenolic resin, and subjecting the thus produced resin to metallization of a polyvalent metal. This technique is disclosed in U.S. Pat. Nos. 4,759,797 and 4,749,680 as well as European Patent Laid-open Publication No. 275,110. Typically, the polyvalent metallized carboxy-modified terpene phenolic resin is prepared as follows: Phenol and α-pinene are condensed in the presence of a boron trifluoride catalyst in order to form a copolycondensation resin, and a carbon dioxide gas is then introduced into this resin in the presence of metallic sodium so as to carboxylate the resin. Afterward, the resin is subjected to metallization of a polyvalent metal by the use of zinc chloride in order to obtain the desired polyvalent metallized carboxy-modified terpene phenolic resin. In this case, examples of the polyvalent metals are zinc, aluminum, barium, tin, iron, calcium and lead. The particularly preferable metal is zinc. In the present invention, the polyvalent metallized carboxy-modified terpene phenolic resin or the derivative thereof, when used, can be mixed or melted/mixed with an aromatic carboxylic acid such as alicylic acid or its metallic salt in a solution or a dispersion medium. In the case that the kerosine fraction is used as the component in the above-mentioned paragraph (a), it is particularly preferred that the developer is the polyvalent metallized carboxy-modified terpene phenolic resin or the derivative thereof.

An electro donating material which is used as the color former in the present invention is colorless or faintly colored at ordinary temperature, and it is a substance which develops a color, when reacted with an electron accepting material. The known color former which are usually used in this technical field can all be employed in the present invention.

Typical examples of the color former include triphenylmethane compounds such as 3,3-bis(p-dimethylaminophenyl)-6dimethylaminophthalide (hereinafter referred to as "CVL" at times), 3,3-bis-(p-dimethylaminophenyl)phthalide, 3-(p-dimethylaminophenyl)-3-(1,2-dimethylindole-3-yl)phthalide, 3-(p-dimethylaminophenyl)-3-(2-mehylindole-3-yl)phthalide, 3,3-bis-(1,2-dimethylindole-3-yl)-5-dimethylaminophthalide, 3,3-bis-(1,2-dimethylindole-3-yl)-6-dimethylaminophthalide, 3,3-bis-(9-ethylcarbazole-3-yl)-5-dimethylaminophthalide, 3,3-bis-(2-phenylindole-3-yl)-5-dimethylaminophthalide, 3-p-dimethylaminophenyl-3-(1-methylpyrrole-2-yl)-6-dimethylaminophthalide; diphenylmethane compounds such as 4,4'-bisdimethylaminobenzhydrine benzyl ether, N-halophenyl-leuco Auramine and N-2,4,5-trichlorophenylleuco Auramine; fluoran compounds such as rhodamine-B-anilinolactam, rhodamine-(P-nitroanilino)lactam, rhodamine B (P-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino-(3-acetylmethylamino)fluoran, 7-diethylamino-(3-methylamino)-fluoran, 3,7-diethylaminofluoran, 7-diethylamino-3-(dibenzylamino)fluoran, 7-diethylamino-3-(methylbenzylamino)fluoran, 7-diethylamino-3-(chloroethylmethylamino)fluoran, 7-diethylamino-3-(diethylamino)-fluoran and 2-phenylamino-3-methyl-6-(N-ethyl-N-p-tolyl)-amino-fluoran; thiazine compounds such as benzoylleuco Methylene Blue and p-nitrobenzylleuco Methylene Blue; spiro compounds such as 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiropyran, 3-propyl-spiro-dibenzopyran; and mixtures thereof.

Reference will be made to a general preparation method of a pressure sensitive copy paper which is one example of the pressure sensitive copy material of the present invention. In the first place, 0.1 to 10% by weight of the above-mentioned color former is dissolved in the solvent composition regarding the present invention, and this solution was then emulsified and dispersed in a mixed aqueous solution of gelatin and gum arabic. Afterward, a gelatin film is formed around the emulsified oil droplets by the coacervation method. In recent years, the in-situ polymerization method, an interfacial polymerization method or the like is often used to form microcapsules of a synthetic resin film.

The thus prepared capsule emulsion of the fine oil droplets is applied onto a paper, and the above-mentioned developer is applied onto the surface of another paper which confronts the applied surface of the emulsion paper, whereby the pressure sensitive copy material is prepared.

BEST EMBODIMENTS TO PRACTICE THE INVENTION

The First Experiments: Experiments where the component in the above-mentioned paragaraph (a) was a hydrogenated lower polymer of propylene and/or a butene

Experimental Example-A

A hydrogenated lower polymer was used (viscosity at 40° C.=1.2 cSt; boiling point range=170°-190° C.). This polymer was prepared by first polymerizing butenes principally comprising isobutene in the presence of an aluminum chloride catalyst to form a lower polymer mainly comprising a trimer, and then hydrogenating the lower polymer.

Phenylxylylethane (boiling point=290°-305° C.; viscosity at 40° C.=5.1 cSt) was used as an aromatic hydrocarbon oil having 2 aromatic rings. This was mixed with the hydrogenated butene trimer to prepare the undermentioned color former solvents. The thus prepared color former solutions were compared in the stability of the color former solutions themselves and color development velocity of pressure sensitive copy papers thereof. With regard to the samples of these solutions, A-1 was for a control, A-2 and A-6 were for comparative examples, and A-3, A-4 and A-5 were for examples of the present invention.

The stability of the color former solutions was evaluated as follows: Each color former solution was warmed, and its 5% Crystal Violet lactone (CVL) solution was then prepared. Afterward, the CVL solution was allowed to stand for 5 hours. At this time, CVL crystals were deposited in certain cases. The evaluation of the stability was made on the basis of presence or absence of the CVL crystals. The color development velocity was measured as follows: The 5% CVL solution was formed into microcapsules by the in-situ polymerization process using urea and formalin, and paste and a protective agent were then added to the resulting microcapsule emulsion. Afterward, the emulsion was applied onto a fine paper by the use of a Meyer bar, thereby making an upper sheet of a pressure sensitive copy paper. A lower sheet thereof was made by applying zinc 3,5-di-(α-methylbenzyl)salicylate as a developer onto a fine paper, and another lower sheet of the pressure sensitive copy paper was made by applying a carboxy-modified terpene phenolic resin containing zinc onto a fine paper. The aforesaid carboxy-modified terpene phenolic resin was prepared by first carboxylating a condensation resin of phenol and α-pinene with a carbon dioxide gas, and then reacting the thus carboxylated compound with zinc chloride. The upper sheet was then superposed on the lower sheet so that the microcapsules-applied surface of the upper sheet might be brought into contact with the developer-applied surface of the lower sheet, and an impact type printing machine was used to develop a color.

Three seconds and 60 minutes after the color development (impact), the reflectance of the lower sheet was measured by means of a reflecting type spectrophotometer to obtain a color density. A ratio of the color density after seconds to the color density after 60 minutes was regarded as the color development velocity. This measurement was carried out at −3° C. The results are set forth in Table 1.

Each color development velocity in the table was indicated with a ratio (relative value) to a color development velocity in the case of phenylxylylethane alone. Also in the undermentioned experiments, each color development velocity was similarly indicated with a ratio (relative value) to a color development velocity in the case of a corresponding bicyclic aromatic hydrocarbon alone.

As seen from the results in Table 1, the solvent compositions of the present invention had a higher color development velocity than phenylxylylethane alone, and the stability of the color former solution was also excellent.

Experimental Example-B

Diisopropylnaphthalene (boiling point=292°-305° C.; viscosity at 40° C.=6.3 cSt) was used as a bicyclic aromatic hydrocarbon oil, and the stability of coupler solutions and the color development velocity of pressure sensitive copy papers thereof were measured in the same manner as in Experimental Example-A. The results are set forth in Table 2. In this table, B-1 was for a control, B-2 and B-5 were for comparative examples, and B-3 and B-4 were for examples of the present invention. The solvent compositions of the present invention were excellent in both of color development velocity and stability of the coupler solution, as in Experimental Example-A.

Experimental Example-C

Partially hydrogenated terphenyl (boiling point=330°-390° C.; viscosity at 40° C.=24.0 cSt) was used as a bicyclic aromatic hydrocarbon oil, and the stability of coupler solutions and the color development velocity of pressure sensitive copy papers thereof were measured in the same manner as in Experimental Example-A. The results are set forth in Table 3. In this table, C-1 was for a control, C-2 and C-4 were for comparative examples, and C-3 was for the example of the present invention. The solvent compositions of the present invention were excellent in both of color development velocity and stability of the color former solution, as in Experimental Example-A.

Experimental Example-D

"Empara K-45" (trade name; made by Ajinomoto Co., Inc.) (viscosity at 40° C.=51 cSt) was used as a chlorinated paraffin oil, and the stability of color former solutions and the color development velocity of pressure sensitive copy papers were measured in the same manner as in Experimental Example-A. The results are set forth in Table 4. In this table, D-1 was for a control, D-2 and D-4 were for comparative examples, and D-3 was for the example of the present invention. The solvent compositions of the present invention were excellent in both of color development velocity and stability of the color former solution, as in Experimental Example-A.

Experimental Example-E

This experiment was carried out as a comparative example.

Phenylethylphenylmethane (boiling point=290°-295° C.; viscosity at 40° C.=2.7 cSt) was used as a bicyclic aromatic hydrocarbon oil, and the color development velocity of pressure sensitive copy papers was then measured in the same manner as in Experimental Example-A and the odor of a color former solution was inspected. The results are set forth in Table 5. In this experimental example, the color development velocity was not improved, even when the hydrogenated lower polymer having the low viscosity was added thereto, and the odor of the color former solution was bad.

Experimental Example-F

This experiment was carried out as a comparative example.

A commercially available novolak type para-phenylphenolic resin was used as a developer, and phenylxylylethane was used as a bicyclic aromatic hydrocarbon oil. The color development velocity of pressure sensitive copy papers was then measured in the same manner as in Experimental Example-A. The results are set forth in Table 6. It was apparent that the color development velocity in this case was low in contrast to the case where a zinc salt of a salicylic acid derivative or a polyvalent metallized carboxy-modified terpene phenolic resin was used as the developer.

Experimental Example-G

This experiment was carried out as a comparative example.

A hydrogenated lower polymer mainly comprising a pentamer of butenes was used as a solvent. This polymer had a boiling point range of 280°-302° C. and a viscosity of 7 cSt at 40° C.

Phenylxylylethane was used as a hydrocarbon oil having 2 aromatic rings, and a color former solution was prepared in the same manner as in Experimental Example-A. Pressure sensitive copy papers were made by the use of this color former solution, and the color development velocity of the thus made copy papers was then measured. The results are set forth in Table 7.

According to this experiment, it was apparent that the color development velocity of phenylxylylethane was not improved, even when the solvent having the great viscosity was added thereto.

As seen from the foregoing, the pressure sensitive copy papers of the present invention are excellent in the color development velocity at low temperatures.

As described above, it is not previously foreseeable that only when the solvent composition containing the hydrocarbon having the specific viscosity at the sepcific ratio is combined with the specific developer, the stability of the dye solution and the excellent color development performance at low temperatures can be obtained.

TABLE 1

| Solvent | A-1 | A-2 | A-3 | A-4 | A-5 | A-6 |
|---|---|---|---|---|---|---|
| Mixing Ratio (vol %) | | | | | | |
| Butene Lower Polymer Hydrocarbon | 0 | 3 | 20 | 30 | 40 | 60 |
| Bicyclic Aromatic Hydrocarbon Oil | 100 | 97 | 80 | 70 | 60 | 40 |
| Color Former Solubility | ○ | ○ | ○ | ○ | ○ | X |
| Color Development Velocity Ratio | | | | | | |
| Salicylic Acid Comp. | 1.00 | 1.02 | 1.10 | 1.12 | 1.12 | — |
| Terpene Resin | 1.00 | 1.08 | 1.33 | 1.42 | 1.51 | — |

Note (which shall apply hereinafter):
○: In the color former solution, no crystals were deposited.
X: In the color former solution, crystals were deposited.
—: In the color former solution, crystals were deposited, and so capsules could not be formed.

TABLE 2

| Solvent | B-1 | B-2 | B-3 | B-4 | B-5 |
|---|---|---|---|---|---|
| Mixing Ratio (vol %) | | | | | |
| Butene Lower Polymer Hydrocarbon | 0 | 3 | 20 | 40 | 60 |
| Bicyclic Aromatic Hydrocarbon Oil | 100 | 97 | 80 | 60 | 40 |
| Color Former Solubility | ○ | ○ | ○ | ○ | X |
| Color Development Velocity Ratio | | | | | |
| Salicylic Acid Comp. | 1.0 | 1.0 | 1.1 | 1.2 | — |

TABLE 3

| Solvent | C-1 | C-2 | C-3 | C-4 |
|---|---|---|---|---|
| Mixing Ratio (vol %) | | | | |
| Butene Lower Polymer Hydrocarbon | 0 | 3 | 30 | 60 |
| Bicyclic Aromatic Hydrocarbon Oil | 100 | 97 | 70 | 40 |
| Color Former Solubility | ○ | ○ | ○ | X |
| Color Development Velocity Ratio | | | | |
| Salicylic Acid Comp. | 1.0 | 1.0 | 1.3 | — |

TABLE 4

| Solvent | D-1 | D-2 | D-3 | D-4 |
|---|---|---|---|---|
| Mixing Ratio (vol %) | | | | |
| Butene Lower Polymer Hydocarbon | 0 | 3 | 30 | 60 |
| Chlorinated Paraffin Oil | 100 | 97 | 70 | 40 |
| Color Former Solubility | ○ | ○ | ○ | X |
| Color Development Velocity Ratio | | | | |
| Salicylic Acid Comp. | 1.0 | 1.0 | 1.4 | — |

TABLE 5

| Solvent | E-1 | E-2 |
|---|---|---|
| Mixing Ratio (vol %) | | |
| Butene Lower Polymer Hydrocarbon | 0 | 30 |
| Bicyclic Aromatic Hydrocarbon Oil | 100 | 70 |
| Color Development Velocity Ratio | | |
| Salicylic Acid Comp. | 1.0 | 0.9 |
| Odor of Solvent | Strong | Strong |

TABLE 6

| Solvent | F-1 | F-2 |
|---|---|---|
| Mixing Ratio (vol %) | | |
| Butene Lower Polymer Hydrocarbon | 0 | 30 |
| Bicyclic Aromatic Hydrocarbon Oil | 100 | 70 |
| Color Development Velocity Ratio | | |
| Phenolic Resin | 1.0 | 0.7 |

TABLE 7

| Solvent | G-1 | G-2 |
|---|---|---|
| Mixing Ratio (vol %) | | |
| Butene Lower Polymer Hydrocarbon | 0 | 30 |
| Bicyclic Aromatic Hydrocarbon Oil | 100 | 70 |
| Color Development | | |

TABLE 7-continued

| Solvent | G-1 | G-2 |
|---|---|---|
| Velocity Ratio | | |
| Salicylic Acid Comp. | 1.0 | 0.8 |

The Second Experiments: Experiments where the component in the above-mentioned paragraph (a) was an alicyclic hydrocarbon Experimental Example-A A commercially available alicyclic hydrocarbon solvent (viscosity at 40° C.=1.8 cSt; boiling point range=215°-245° C.) prepared by subjecting a petroleum fraction to a nuclear hydrogenation treatment was used as an alicyclic hydrocarbon. This solvent contained 70% or more of the alicyclic hydrocarbon.

Phenylxylylethane (boiling point=290°-305° C.; viscosity at 40° C.=5.1 cSt) was used as a hydrocarbon oil having 2 aromatic rings, and it was then mixed with the above-mentioned alicyclic hydrocarbon solvent in order to prepare the undermentioned color former solutions. The thus prepared color former solutions were compared in the stability of the color former solutions themselves and the color development velocity of pressure sensitive copy papers thereof. With regard to the samples of these solutions, A-1 was for a control, A-2 and A-6 were for comparative examples, and A-3, A-4 and A-5 were for examples of the present invention.

The stability of the color former solutions was evaluated as follows: Each color former solution was warmed, and its 5% Crystal Violet lactone (CVL) solution was then prepared. Afterward, the CVL solution was allowed to stand for 5 hours. At this time, CVL crystals were deposited in certain cases. The evaluation of the stability was made on the basis of presence or absence of the CVL crystals. The color development velocity was measured as follows: The 5% CVL solution was formed into microcapsules by the in-situ polymerization process using urea and formalin, and paste and a protective agent were then added to the resulting microcapsule emulsion. Afterward, the emulsion was applied onto a fine paper by the use of a Meyer bar, thereby making an upper sheet of a pressure sensitive copy paper. A lower sheet thereof was made by applying zinc 3,5-di-(α-methylbenzyl)salicylate as a developer onto a fine paper, and another lower sheet thereof was made by applying a carboxy-modified terpene phenolic resin containing zinc onto a fine paper. The aforesaid carboxy-modified terpene phenolic resin was prepared by first carboxylating a condensation resin of phenol and α-pinene, and then reacting the thus carboxylated compound with zinc chloride. The upper sheet was then superposed on the lower sheet so that the microcapsules-applied surface of the upper sheet might be brought into contact the developer-applied surface of the lower sheet, and an impact type printing machine was used to develop a color.

Three second sand 60 minutes after the color development, the reflectance of the lower sheet was measured by means of a reflecting type spectrophotometer to obtain a color density. A ratio of the color density after 3 seconds to the color density after 60 minutes was regarded as the color development velocity. This measurement was carried out at −3° C. The results are set forth in Table 1.

Each color development velocity in the table was indicated with a ratio to a color development velocity in the case of phenylxylylethane alone. Also in the undermentioned experiments, each color development velocity was similarly indicated with a ratio (relative value) to a color development velocity in an example of a corresponding bicyclic aromatic hydrocarbon alone.

As seen from the results in Table 1, when the solvent compositions of the present invention is used, the color development velocity is higher than in the case of phenylxylylethane alone, and the stability of the color former solution is also excellent.

Experimental Example-B

Diisopropylnaphthalene (boiling point=292°-305° C.; viscosity at 40° C.=6.3 cSt) was used as a bicyclic aromatic hydrocarbon oil, and the stability of color former solutions and the color development velocity of pressure sensitive copy papers thereof were measured in the same manner as in Experimental Example-A. The results are set forth in Table 2. In this table, B-1 was for a control, B-2 and B-5 were for comparative examples, and B-3 and B-4 were for examples of the present invention. The solvent compositions of the present invention were excellent in both of color development velocity and stability of the color former solutions, as in Experimental Example-A.

Experimental Example-C

Partially hydrogenated terphenyl (boiling point=330°-390° C.; viscosity at 40° C.=24.0 cSt) was used as a bicyclic aromatic hydrocarbon oil, and the stability of color former solutions and the color development velocity of pressure sensitive copy papers thereof were measured in the same manner as in Experimental Example-A. The results are set forth in Table 3. In this table, C-1 was for a control, C-2 and C-4 were for comparative examples, and C-3 was for the example of the present invention. The solvent compositions of the present invention were excellent in color development velocity and stability of the color former solution, as in Experimental Example-A.

Experimental Example-D

"Empara K-45" (trade name; made by Ajinomoto Co., Inc.) (viscosity at 40° C.=51 cSt) was used as a chlorinated paraffin oil, and the stability of color former solutions and the color development velocity of pressure sensitive copy papers thereof were measured in the same manner as in Experimental Example-A. The results are set forth in Table 4. In this table, D-1 was for a control, D-2 and D-4 were for comparative examples, and D-3 was for the example of the present invention. The solvent compositions of the present invention were excellent in both of color development velocity and stability of the color former solution, as in Experimental Example-A.

Experimental Example-E

This experiment was carried out as a comparative example.

Phenylethylphenylmethane (boiling point=290°-295° C.; viscosity at 40° C.=2.7 cSt) was used as a bicyclic aromatic hydrocarbon oil, and the same commercial solvent as in Experiment 1 was used as an alicyclic solvent. The color development velocity of pressure sensitive copy papers was then measured in the same manner as in Experimental Example-A, and the odor of color former solvents was inspected. The results are set forth in Table 5. In this experimental example, the color development velocity was not improved, even when the alicyclic solvent having the low viscosity was added thereto, and the odor of the color former solvent was bad.

Experimental Example-F

This experiment was carried out as a comparative example.

A commercially available novolak type para-phenylphenolic resin was used as a developer, and phenylxylylethane was used as a bicyclic aromatic hydrocarbon oil. The color development velocity of pressure sensitive copy papers was then measured in the same manner as in Experimental Example-A. The results are set forth in Table 6. It was apparent that the color development velocity in this case was low in contrast to the case where a zinc salt of a salicylic acid derivative or a polyvalent metallized carboxy-modified terpene phenolic resin was used as the developer.

As seen from the above examples, the pressure sensitive copy paper of the present invention is excellent in the color development velocity at low temperatures.

Moreover, it is not previously foreseeable that only when the solvent composition containing the hydrocarbon having the specific viscosity at the sepcific ratio is combined with the specific developer, the stability of the dye solution and the excellent color development performace at low temperatures can be obtained.

TABLE 1

| Solvent | A-1 | A-2 | A-3 | A-4 | A-5 | A-6 |
|---|---|---|---|---|---|---|
| Mixing Ratio (vol %) | | | | | | |
| Naphthene Hydrocarbon | 0 | 3 | 20 | 30 | 40 | 60 |
| Bicyclic Aromatic Hydrocarbon Oil | 100 | 97 | 80 | 70 | 60 | 40 |
| Color Former Solubility | ○ | ○ | ○ | ○ | ○ | X |
| Color Development Velocity Ratio | | | | | | |
| Salicylic Acid Comp. | 1.00 | 1.01 | 1.15 | 1.19 | 1.21 | — |
| Terpene Resin | 1.00 | 1.10 | 1.37 | 1.49 | 1.55 | — |

Note (which shall apply hereinafter):
○: In the color former solution, no crystals were deposited.
X: In the color former solution, crystals were deposited.
—: In the color former solution, crystals were deposited, and so capsules could not be formed.

TABLE 2

| Solvent | B-1 | B-2 | B-3 | B-4 | B-5 |
|---|---|---|---|---|---|
| Mixing Ratio (vol %) | | | | | |
| Naphthene Hydrocarbon | 0 | 3 | 20 | 40 | 60 |
| Bicyclic Aromatic Hydrocarbon Oil | 100 | 97 | 80 | 60 | 40 |
| Color Former Solubility | ○ | ○ | ○ | ○ | X |
| Color Development Velocity Ratio | | | | | |
| Salicylic Acid Comp. | 1.0 | 1.0 | 1.2 | 1.3 | — |

TABLE 3

| Solvent | C-1 | C-2 | C-3 | C-4 |
|---|---|---|---|---|
| Mixing Ratio (vol %) | | | | |
| Naphthene Hydrocarbon | 0 | 3 | 30 | 60 |
| Bicyclic Aromatic Hydrocarbon Oil | 100 | 97 | 70 | 40 |
| Color Former Solubility | ○ | ○ | ○ | X |
| Color Development Velocity Ratio | | | | |

TABLE 3-continued

| Solvent | C-1 | C-2 | C-3 | C-4 |
|---|---|---|---|---|
| Salicylic Acid Comp. | 1.0 | 1.0 | 1.3 | — |

TABLE 4

| Solvent | D-1 | D-2 | D-3 | D-4 |
|---|---|---|---|---|
| Mixing Ratio (vol %) | | | | |
| Butene Lower Polymer Hydrocarbon | 0 | 3 | 30 | 60 |
| Bicyclic Aromatic Hydrocarbon Oil | 100 | 97 | 70 | 40 |
| Color Former Solubility | ○ | ○ | ○ | X |
| Color Development Velocity Ratio | | | | |
| Salicylic Acid Comp. | 1.0 | 1.0 | 1.4 | — |

TABLE 5

| Solvent | E-1 | E-2 |
|---|---|---|
| Mixing Ratio (vol %) | | |
| Naphthene Hydrocarbon | 0 | 30 |
| Bicyclic Aromatic Hydrocarbon Oil | 100 | 70 |
| Color Development Velocity Ratio | | |
| Salicylic Acid Comp. | 1.00 | 0.95 |
| Solvent Odor | Strong | Strong |

TABLE 6

| Solvent | F-1 | F-2 |
|---|---|---|
| Mixing Ratio (vol %) | | |
| Naphthene Hydrocarbon | 0 | 30 |
| Bicyclic Aromatic Hydrocarbon Oil | 100 | 70 |
| Color Development Velocity Ratio | | |
| Phenolic Resin | 1.00 | 0.64 |

The Third Experiments: Experiments where the component in the above-mentioned paragraph (a) was an alkylbenzene

Experimental Example-A

A mixture (viscosity at 40° C.=2.0 cSt; boiling point=200° C. or more) of $C_{13}$–$C_{15}$ alkylbenzenes prepared by alkylating benzene with a $C_7$–$C_9$ olefin mixture was used as an alkylbenzene.

Phenylxylylethane (boiling point=290°–305° C.; viscosity at 40° C.=5.1 cSt) was used as a hydrocarbon oil having 2 aromatic rings, and this compound was mixed with the above-mentioned alkylbenzene in order to prepare the undermentioned color former solvents. The thus prepared color former solutions were compared in the stability of the color former solutions themselves and the color development velocity of pressure sensitive copy papers thereof. With regard to the samples of these solutions, A-1 was for a control, A-2 and A-6 were for comparative examples, and A-3, A-4 and A-5 were for examples of the present invention.

The stability of the color former solutions was evaluated as follows: A 5% Crystal Violet lactone (CVL) solution of each color former solution was prepared and was then allowed to stand for 5 hours. At this time, CVL crystals were deposited in certain cases. The evaluation of the stability was made on the basis of presence or absence of the CVL crystals. The color development velocity was measured as follows: The 5% CVL solution was formed into microcapsules by the in-situ polymerization process using urea and formalin, and paste and a protective agent were then added to the resulting microcapsule emulsion. Afterward, the emulsion was applied onto a fine paper by the use of a Meyer bar, thereby making an upper sheet of a pressure sensitive copy paper.

A lower sheet of the copy paper was made by applying zinc 3,5-di-(α-methylbenzyl)salicylate as a developer onto a fine paper, and another lower sheet thereof was made by applying a carboxy-modified terpene phenolic resin containing zinc onto a fine paper. The aforesaid carboxy-modified terpene phenolic resin was prepared by first carboxylating a condensation resin of phenol and α-pinene with a carbon dioxide gas, and then reacting the thus carboxylated compound with zinc chloride. The upper sheet was then superposed on the lower sheet so that the microcapsules-applied surface of the upper sheet might be brought into contact with the developer-applied surface of the lower sheet, and an impact type printing machine was used to develop a color.

Three seconds and 60 minutes after the color development, the reflectance of the lower sheet was measured by means of a reflecting type spectrophotometer to obtain a color density. A ratio of the color density after 3 seconds to the color density after 60 minutes was regarded as the color development velocity. This measurement was carried out at −3° C. The results are set forth in Table 1.

Each color development velocity in the table was indicated with a ratio (relative value) to a color development velocity in the case of phenylxylylethane alone. Also in the undermentioned experimental examples, each color development velocity was similarly indicated with a relative value to a color development velocity in an example of a corresponding bicyclic aromatic hydrocarbon alone.

As seen from the results in Table 1, when the solvent compositions of the present invention is used, the color development velocity is higher than in the case of phenylxylylethane alone, and the stability of the color former solution is also excellent.

Experimental Example-B

Diisopropylnaphthalene (boiling point=292°-305° C.; viscosity at 40° C.=6.3 cSt) was used as a bicyclic aromatic hydrocarbon oil, and the stability of color former solutions and the color development velocity of pressure sensitive copy papers thereof were measured in the same manner as in Experimental Example-A. The results are set forth in Table 2. In this table, B-1 was for a control, B-2 and B-5 were for comparative examples, and B-3 and B-4 were for examples of the present invention. The solvents of the present invention were excellent in both of color development velocity and stability of the color former solutions, as in Experimental Example-A.

Experimental Example-C

Partially hydrogenated terphenyl (boiling point=330°-390° C.; viscosity at 40° C.=24.0 cSt) was used as a bicyclic aromatic hydrocarbon oil, and the stability of color former solutions and the color development velocity of pressure sensitive copy papers thereof were measured in the same manner as in Experimental Example-A. The results are set forth in Table 3. In this table, C-1 was for a control, C-2 and C-4 were for comparative examples, and C-3 was for the example of the present invention. The solvents of the present invention were excellent in both of color development velocity and stability of the color former solution, as in Experimental Example-A.

Experimental Example-D

"Empara K-45" (trade name; made by Ajinomoto Co., Inc.; viscosity at 40° C.=51 cSt) was used as a chlorinated paraffin oil, and the stability of color former solutions and the color development velocity of pressure sensitive copy papers thereof were measured in the same manner as in Experimental Example-A. The results are set forth in Table 4. In this table, D-1 was for a control, D-2 and D-4 were for comparative examples, and D-3 was for the example of the present invention. The solvents of the present invention were excellent in both of color development velocity and stability of the color former solution, as in Experimental Example-A.

Experimental Example-E

This experiment was carried out as a comparative example.

Phenylethylphenylmethane (boiling point=290°-295° C.; viscosity at 40° C.=2.7 cSt) was used as a bicyclic aromatic hydrocarbon oil, and the color development velocity of pressure sensitive copy papers thereof was then measured in the same manner as in Experimental Example-A, and the odor of color former solvents was inspected. The results are set forth in Table 5. In this experimental example, the color development velocity was not improved, even when the alkylbenzene having the low viscosity was added thereto, and the odor of the color former solution was bad.

Experimental Example-F

This experiment was carried out as a comparative example.

A commercially available novolak type para-phenylphenolic resin was used as a developer, and phenylxylylethane was used as a bicyclic aromatic hydrocarbon oil. The color development velocity of pressure sensitive copy papers thereof was then measured at ordinary temperature in the same manner as in Experimental Example-A. The results are set forth in Table 6. It was apparent that the color development velocity in this case was low in contrast to the case where a zinc salt of a salicylic acid derivative or a polyvalent metallized carboxy-modified terpene phenolic resin was used as the developer.

Experimental Examples-G

This experiment was carried out as a comparative example.

A mixture of $C_{16}$–$C_{18}$ alkylbenzenes was used as an alkylbenzene. This mixture had a viscosity of 3.6 cSt at 40° C. and a boiling point of 280°-300° C.

Phenylxylylethane was used as a hydrocarbon oil having 2 aromatic rings, and the color development velocity of pressure sensitive copy papers thereof was then measured in the same manner as in Experimental Example-A. The results are set forth in Table 7.

In this experiment, the color development velocity was not improved, even when the alkylbenzene having the high viscosity was added thereto.

Experimental Example-H $C_{13}$–$C_{14}$ alkylbenzenes prepared by alkylating xylene with $C_5$–$C_6$ olefins were used as an alkylbenzene. This had a viscosity of 1.9 cSt at 40° C. and a boiling point of 200° C. or more. Phenylxylylethane was used as a hydrocarbon oil having 2 aromatic rings, and the stability of color former solutions and the color development velocity of pressure sensitive copy papers thereof were then measured in the same manner as in Experimental Example-A. The results are set forth in Table 8. In this table, H-1 was for a control, and H-2 was for an example of the present invention. The pressure sensitive paper solvent, in which the solvent of the present invention was used, was excellent in the color development velocity. Although not shown in the table, the color former solution, in which the H-2 solvent was used, was excellent in stability.

As seen from the above examples, the pressure sensitive copy paper of the present invention is excellent in the color development velocity at low temperatures.

Moreover, it is not previously foreseeable that only when the solvent composition containing the hydrocarbon having the specific viscosity at the specific ratio is combined with the specific developer, the stability of the dye solution and the excellent color development performace at low temperatures can be obtained.

TABLE 1

| Solvent | A-1 | A-2 | A-3 | A-4 | A-5 | A-6 |
|---|---|---|---|---|---|---|
| Mixing Ratio (vol %) | | | | | | |
| Alkylbenzene | 0 | 3 | 20 | 30 | 40 | 60 |
| Bicyclic Aromatic Hydrocarbon Oil | 100 | 97 | 80 | 70 | 60 | 40 |
| Color Former Solubility | ○ | ○ | ○ | ○ | ○ | X |
| Color Development Velocity Ratio | | | | | | |
| Salicylic Acid Comp. | 1.00 | 1.03 | 1.14 | 1.16 | 1.18 | — |
| Terpene Resin | 1.00 | 1.10 | 1.46 | 1.58 | 1.64 | — |

Note
○: In the color former solution, no crystals were deposited.
X: In the color former solution, crystals were deposited.
—: In the color former solution, crystals were deposited, and so capsules could not be formed.

TABLE 2

| Solvent | B-1 | B-2 | B-3 | B-4 | B-5 |
|---|---|---|---|---|---|
| Mixing Ratio (vol %) | | | | | |
| Alkylbenzene | 0 | 3 | 20 | 40 | 60 |
| Bicyclic Aromatic Hydrocarbon Oil | 100 | 97 | 80 | 60 | 40 |
| Color Former Solubility | ○ | ○ | ○ | ○ | X |
| Color Development Velocity Ratio | | | | | |
| Salicylic Acid Comp. | 1.0 | 1.1 | 1.2 | 1.3 | — |

TABLE 3

| Solvent | C-1 | C-2 | C-3 | C-4 |
|---|---|---|---|---|
| Mixing Ratio (vol %) | | | | |
| Alkylbenzene | 0 | 3 | 30 | 60 |
| Bicyclic Aromatic Hydrocarbon Oil | 100 | 97 | 70 | 40 |
| Color Former Solubility | ○ | ○ | ○ | X |
| Color Development Velocity Ratio | | | | |
| Salicylic Acid Comp. | 1.0 | 1.0 | 1.3 | — |

TABLE 4

| Solvent | D-1 | D-2 | D-3 | D-4 |
|---|---|---|---|---|
| Mixing Ratio (vol %) | | | | |
| Alkylbenzene | 0 | 3 | 30 | 60 |
| Chlorinated Paraffin Oil | 100 | 97 | 70 | 40 |
| Color Former Solubility | ○ | ○ | ○ | X |
| Color Development Velocity Ratio | | | | |
| Salicylic Acid Comp. | 1.0 | 1.0 | 1.5 | — |

TABLE 5

| Solvent | E-1 | E-2 |
|---|---|---|
| Mixing Ratio (vol %) | | |
| Alkylbenzene | 0 | 30 |
| Bicyclic Aromatic Hydrocarbon Oil | 100 | 70 |
| Color Development Velocity Ratio | | |
| Salicylic Acid Comp. | 1.0 | 1.0 |
| Solvent Odor | Strong | Strong |

TABLE 6

| Solvent | F-1 | F-2 |
|---|---|---|
| Mixing Ratio (vol %) | | |
| Alkylbenzene | 0 | 30 |
| Bicyclic Aromatic Hydrocarbon Oil | 100 | 70 |
| Color Development Velocity Ratio | | |
| Phenolic Resin | 1.0 | 0.9 |

TABLE 7

| Solvent | G-1 | G-2 |
|---|---|---|
| Mixing Ratio (vol %) | | |
| Alkylbenzene | 0 | 30 |
| Bicyclic Aromatic Hydrocarbon Oil | 100 | 70 |
| Color Development Velocity Ratio | | |
| Salicyclic Acid Comp. | 1.0 | 0.9 |

TABLE 8

| Solvent | H-1 | H-2 |
|---|---|---|
| Mixing Ratio (vol %) | | |
| Alkylbenzene | 0 | 30 |
| Bicyclic Aromatic Hydrocarbon Oil | 100 | 70 |
| Color Development Velocity Ratio | | |
| Phenolic Resin | 1.0 | 1.2 |

The Fourth Experiments: Experiments where the component in the above-mentioned paragraph (a) was a kerosine Experimental Example-A A petroleum fraction having a boiling point range of 160°–252° C. was hydrogenated in the presence of a nickel-tungsten catalyst, was then refined, and was distilled to prepare a kerosine having a boiling point range of 175°–195° C. this kerosine fraction had a viscosity of 1.2 cSt at 40° C.

Phenylxylylethane (boiling point = 290°–305° C.; viscosity at 40° C. = 5.1 cSt) was used as a hydrocarbon oil having 2 aromatic rings, and it was then mixed with the above-mentioned kerosine fraction in order to prepare the undermentioned color former solvents. The thus prepared color former solutions were compared in the stability of the color former solutions themselves and the color development velocity of pressure sensitive copy papers thereof. With regard to the samples of these solutions, A-1 was for a control, A-2 and A-6 were for comparative examples, and A-3, A-4 and A-5 were for examples of the present invention.

The stability of the color former solutions was evaluated as follows: A 5% Crystal Violet lactone (CVL) solution of each color former solution was prepared and was then allowed to stand for 5 hours. At this time, CVL crystals were deposited in certain cases. The evaluation of the stability was made on the basis of presence or absence of the CVL crystals. The color development velocity was measured as follows: The 5% CVL solution was formed into microcapsules by the in-situ polymerization process using urea and formalin, and paste and a protective agent were then added to the resulting microcapsule emulsion. Afterward, the emulsion was applied onto a fine paper by the use of a Meyer bar, thereby making an upper sheet of a pressure sensitive copy paper. A lower sheet of the copy paper was made by applying a carboxy-modified terpene phenolic resin containing zinc as a developer onto a fine paper. The aforesaid carboxy-modified terpene phenolic resin was prepared by first carboxylating a condensation resin of phenol and α-pinene with a carbon dioxide gas, and then reacting the thus carboxylated compound with zinc chloride. The upper sheet was then superposed on the lower sheet so that the microcapsules-applied surface of the upper sheet might be brought into contact with the developer-applied surface of the lower sheet, and an impact type printing machine was used to develop a color.

Three seconds and 60 minutes after the color development, the reflectance of the lower sheet was measured by means of a reflecting type spectrophotometer to obtain a color density. A ratio of the color density after 3 seconds to the color density after 60 minutes was regarded as the color development velocity. This measurement was carried out at −3° C. The results are set forth in Table 1.

Each color development velocity in the table was indicated with a ratio to a color development velocity in the case of phenylxylylethane alone. This shall apply in the undermentioned experiments.

As seen from the results in Table 1, when the solvent compositions of the present invention is used, the color development velocity is higher than in the case of phenylxylylethane alone, and the stability of the color former solution is also excellent.

Experimental Example-B

Diisopropylnaphthalene (boiling point=292°-305° C.; viscosity at 40° C.=6.3 cSt) was used as a bicyclic aromatic hydrocarbon oil, and the stability of color former solutions and the color development velocity of pressure sensitive copy papers thereof were measured in the same manner as in Experimental Example-A. The results are set forth in Table 2. In this table, B-1 was for a control, B-2 and B-5 were for comparative examples, and B-3 and B-4 were for examples of the present invention. The solvents of the present invention were excellent in both of color development velocity and stability of the color former solutions, as in Experimental Example-A.

Experimental Example-C

Partially hydrogenated terphenyl (boiling point=330°-390° C.; viscosity at 40° C.=24.0 cSt) was used as a bicyclic aromatic hydrocarbon oil, and the stability of color former solutions and the color development velocity of pressure sensitive copy papers thereof were measured in the same manner as in Experimental Example-A. The results are set forth in Table 3. In this table, C-1 was for a control, C-2 and C-4 were for comparative examples, and C-3 was for the example of the present invention. The solvent compositions of the present invention were excellent in both of color development velocity and stability of the color former solution, as in Experimental Example-A.

Experimental Example-D

"Empara K-45" (trade name; made by Ajinomoto Co., Inc.; viscosity at 40° C.=51 cSt) was used as a chlorinated paraffin oil, and the stability of color former solutions and the color development velocity of pressure sensitive copy papers thereof were measured in the same manner as in Experimental Example-A. The results are set forth in Table 4. In this table, D-1 was for a control, D-2 and D-4 were for comparative examples, and D-3 was for the example of the present invention. The solvent compositions of the present invention were excellent in both of color development velocity and stability of the color former solution, as in Experimental Example-A.

Experimental Example-E

This experiment was carried out as a comparative example.

Phenylethylphenylmethane (boiling point=290°-295° C.; viscosity at 40° C.=2.7 cSt) was used as a bicyclic aromatic hydrocarbon oil, and the color development velocity of pressure sensitive copy papers thereof was then measured in the same manner as in Experimental Example-A, and the odor of color former solutions was inspected. The results are set forth in Table 5. In this experimental example, the color development velocity was not improved, even when the kerosine fraction having the low viscosity was added thereto, and the odor of the color former solution was bad.

Experimental Example-F

This experiment was carried out as a comparative example.

A commercially available novolak type para-phenylphenolic resin was used as a developer, and phenylxylylethane was used as a bicyclic aromatic hydrocarbon oil. The color development velocity of pressure sensitive copy papers thereof was then measured at ordinary temperature in the same manner as in Experimental Example-A. The results are set forth in Table 6. It was apparent that the color development velocity in this case was low in contrast to the case where a polyvalent metallized carboxy-modified terpene phenolic resin was used as the developer.

As seen from the above examples, the pressure sensitive copy papers of the present invention are excellent in the color development velocity at low temperatures.

Moreover, it is not previously foreseeable that only when the solvent containing the hydrocarbon having the specific viscosity at the sepcific ratio is combined with the specific developer, the stability of the dye solution and the excellent color development performace at low temperatures can be obtained.

TABLE 1

| Solvent | A-1 | A-2 | A-3 | A-4 | A-5 | A-6 |
|---|---|---|---|---|---|---|
| Mixing Ratio (vol %) | | | | | | |
| Kerosine Fraction | 0 | 3 | 20 | 30 | 40 | 60 |
| Bicyclic Aromatic Hydrocarbon Oil | 100 | 97 | 80 | 70 | 60 | 40 |
| Color Former Solubility | ○ | ○ | ○ | ○ | ○ | X |
| Color Development Velocity Ratio | | | | | | |
| Terpene Resin | 1.00 | 1.16 | 1.43 | 1.55 | 1.61 | — |

Note:
○: In the color former solution, no crystals were deposited.
X: In the color former solution, crystals were deposited.
—: In the color former solution, crystals were deposited, and so capsules could not be formed.

TABLE 2

| Solvent | B-1 | B-2 | B-3 | B-4 | B-5 |
|---|---|---|---|---|---|
| Mixing Ratio (vol %) | | | | | |
| Kerosine Fraction | 0 | 3 | 20 | 40 | 60 |
| Bicyclic Aromatic Hydrocarbon Oil | 100 | 97 | 80 | 60 | 40 |
| Color Former Solubility | ○ | ○ | ○ | ○ | X |
| Color Development Velocity Ratio | | | | | |
| Terpene Resin | 1.0 | 1.2 | 1.5 | 1.7 | — |

TABLE 3

| Solvent | C-1 | C-2 | C-3 | C-4 |
|---|---|---|---|---|
| Mixing Ratio (vol %) | | | | |
| Kerosene Fraction | 0 | 3 | 30 | 60 |
| Bicyclic Aromatic Hydrocarbon Oil | 100 | 97 | 70 | 40 |
| Color Former Solubility | ○ | ○ | ○ | X |
| Color Development Velocity Ratio | | | | |
| Terpene Resin | 1.0 | 1.2 | 1.6 | — |

TABLE 4

| Solvent | D-1 | D-2 | D-3 | D-4 |
|---|---|---|---|---|
| Mixing Ratio (vol %) | | | | |
| Kerosine Fraction | 0 | 3 | 30 | 60 |
| Chlorinated Paraffin Oil | 100 | 97 | 70 | 10 |
| Color Former Solubility | ○ | ○ | ○ | X |
| Color Development Velocity Ratio | | | | |
| Terpene Resin | 1.0 | 1.1 | 1.7 | — |

TABLE 5

| Solvent | E-1 | E-2 |
|---|---|---|
| Mixing Ratio (vol %) | | |
| Kerosine Fraction | 0 | 30 |
| Bicyclic Aromatic Hydrocarbon Oil | 100 | 70 |
| Color Development Velocity Ratio | | |
| Terpene Resin | 1.0 | 1.0 |
| Solvent Odor | Strong | Strong |

TABLE 6

| Solvent | F-1 | F-2 |
|---|---|---|
| Mixing Ratio (vol %) | | |
| Kerosene Fraction | 0 | 30 |
| Bicyclic Aromatic Hydrocarbon Oil | 100 | 70 |

TABLE 6-continued

| Solvent | F-1 | F-2 |
|---|---|---|
| Color Development Velocity Ratio | | |
| Phenolic Resin | 1.0 | 0.7 |

POSSIBILITY OF INDUSTRIAL UTILIZATION

The pressure sensitive copy material of the present invention has a higher color development velocity than in the case of a conventional single solvent of an aromatic hydrocarbon. In addition, since a hydrogenated lower polymer of propylene to a butene, an alicyclic hydrocarbon, an alkylbenzene and a kerosine fraction are all inexpensive. the present invention can provide the inexpensive copy material.

We claim:

1. A pressure sensitive copy article comprising a color forming solution disposed on a substrate and an electron accepting developer;

said color forming solution including a solvent and an electron donating color former capable of developing a color; said solution comprising (a) from 20% to 50% by volume of a component having a viscosity of less than 3 cSt at 40° C. and a boiling point of at least 170° C. at atmospheric pressure, said component selected from the group consisting of a hydrogenated oligomer of propylene, a hydrogenated oligomer of butene, a hydrogenated oligomer of propylene and butene and an alkylbenzene having 11 to 15 carbon atoms, with the proviso that if a hydrogenated oligomer is utilized it has 12 to 16 carbon atoms; and (b) from 50% to 80% by volume of a component selected from the group consisting of an aromatic hydrocarbon and a chlorinated paraffin, said aromatic hydrocarbon having at least two non-condensed or condensed aromatic rings and characterized by a boiling point of at least 260° C. at atomspheric pressure and a viscosity of at least 3 cSt at 40° C. and said chlorinated paraffin characterized by a viscosity of at least 3 cSt at 40° C.;

said electron accepting developer selected from the group consisting of an aromatic carboxylic acid, a polymer of an aromatic carboxylic acid, a metallic salt of an aromatic carboxylic acid and polyvalent metallized carboxy-modified terpene phenolic resin.

2. The pressure sensitive copy article according to claim 1 wherein said aromatic carboxylic acid is a salicylic acid.

3. The pressure sensitive copy article according to claim 1 wherein said aromatic hydrocarbon has at least two aromatic rings and is selected from the group consisting of diarylalkanes, alkylnaphthalenes, alkylbiphenyls and partially hydrogenated terphenyls.

4. A pressure sensitive copy article comprising a color forming solution disposed on a substrate and an electron accepting developer;

said color forming solution including a solvent and an electron donating color formed capable of developing a color;

said solution comprising (a) from 5% to 50% by volume of a component having a viscosity of less than 3 cSt at 40° C. and a boiling point of at least 170° C. at atmospheric pressure, said component selected from the group consisting of an alicyclic hydrocarbon and a kerosene fraction; and (b) from 50% to 90% by volume of a component selected from the group consisting of an aromatic hydrocarbon and a chlorinated paraffin, said aromatic hydrocarbon having at least two non-condensed or condensed aromatic rings and characterized by a boiling point of at least 260° C. at atmospheric pressure and a viscosity of at least cSt at 40° C. and said chlorinated paraffin characterized by a viscosity of at least 3 cSt at 40° C.;

said electron accepting developer being a polyvalent metallized carboxy-modified terpene phenolic resin.

5. The pressure sensitive copy article according to claim 4, wherein said kerosine fraction substantially comprises a component having a boiling point of at least 170° C.

6. The pressure sensitive copy article according to claim 4 wherein said polyvalent metallized carboxy-modified terpene phenolic resin is a zinc carboxy-modified terpene phenolic resin.

7. The pressure sensitive copy article according to claim 4 wherein said aromatic hydrocarbon has at least two aromatic rings and is selected from the group consisting of diarylalkanes, alkylnaphthalenes, alkylbiphenyls and partially hydrogenated terphenyls.

* * * * *

UNITED STATES PATENT AND TRADEMARK OFFICE

CERTIFICATE OF CORRECTION

PATENT NO. : 5,214,021

DATED : May 25, 1993

INVENTOR(S) : Naoya Takahashi, et al.

It is certified that error appears in the above-indentified patent and that said Letters Patent is hereby corrected as shown below:

Column 1, line 15: after "developer" insert --comprising an aromatic carboxylic acid, a polymer thereof, a--

Column 3, lines 34-45: after "alkyltetralins" insert --.--

Column 5, line 50: "carboxyl" should read as --carboxy--

Column 6, line 18: after "6" insert -- - --

Column 7, line 67: after "after" insert --3--

Column 8, lines 33-34: "33-0°" should read as --330°--

Column 8, lines 65-66: "29-0°" should read as --290°--

Column 12, lines 28-29: "33-0°" should read as --330°--

Column 12, lines 61-62: "29-0°" should read as --290°--

UNITED STATES PATENT AND TRADEMARK OFFICE

CERTIFICATE OF CORRECTION

PATENT NO. : 5,214,021 Page 2 of 2

DATED : May 25, 1993

INVENTOR(S) : Naoya Takahashi, et al.

It is certified that error appears in the above-indentified patent and that said Letters Patent is hereby corrected as shown below:

Column 15, lines 63-64: "33-0°" should read as --330°--

Column 16, lines 26-27: "29-0°" should read as --290°--

Column 20, lines 3-4: "33-0°" should read as --330°--

Column 20, lines 35-36: "29-0°" should read as --290°--

Column 21, lines 45: "10" should read as --40--

Signed and Sealed this

Twelfth Day of April, 1994

Bruce Lehman

*Attest:*

BRUCE LEHMAN

*Commissioner of Patents and Trademarks*

*Attesting Officer*